US007318484B2

(12) United States Patent
Rousseau et al.

(10) Patent No.: US 7,318,484 B2
(45) Date of Patent: Jan. 15, 2008

(54) SELF SERVICING FIRE EXTINGUISHER WITH EXTERNAL OPERATED INTERNAL MIXING WITH WIDE MOUTH AND EXTERNAL PRESSURIZED CANISTER

(76) Inventors: Hector Rousseau, P.O. Box 70616, Riverside, CA (US) 92513; Randy Rousseau, P.O. Box 70616, Riverside, CA (US) 92513

( * ) Notice: Subject to any disclaimer, the term of this patent is extended or adjusted under 35 U.S.C. 154(b) by 0 days.

(21) Appl. No.: 11/515,471

(22) Filed: Sep. 1, 2006

(65) Prior Publication Data

US 2007/0102167 A1 May 10, 2007

Related U.S. Application Data

(63) Continuation-in-part of application No. 11/266,815, filed on Nov. 4, 2005, now Pat. No. 7,128,163.

(51) Int. Cl.
*A62C 39/00* (2006.01)

(52) U.S. Cl. ..... 169/77; 169/9; 169/85; 169/88; 239/142; 239/373; 222/226; 222/399; 366/102; 366/279; 366/332; 366/343; 406/135

(58) Field of Classification Search ..... 169/9, 169/30, 71, 72, 76, 77, 85, 88, 89; 239/142, 239/143, 325, 373; 222/226, 195, 394, 399, 222/630; 366/102–104, 279, 332, 342, 343; 406/38, 134, 135

See application file for complete search history.

(56) References Cited

U.S. PATENT DOCUMENTS 1,272,012 A 7/1918 Connor
1,733,724 A 10/1929 Downs
2,067,829 A 1/1937 Dennel
2,208,490 A * 7/1940 Axtell et al. ..... 169/88
2,430,470 A 11/1947 Keefe, Jr.
2,489,339 A 11/1949 Stroop
2,533,685 A * 12/1950 Nurkiewicz ..... 222/399
2,541,554 A 2/1951 Smith
2,547,954 A * 4/1951 Mapes et al. ..... 222/399
2,557,120 A * 6/1951 Knoblock ..... 222/399
2,785,759 A 3/1957 Fleming et al.
3,251,420 A * 5/1966 Rodgers ..... 169/77
3,255,824 A 6/1966 Rodgers
3,618,669 A 11/1971 Sachs
3,650,329 A * 3/1972 Sachs ..... 169/85

(Continued)

*Primary Examiner*—Steven J. Ganey
(74) *Attorney, Agent, or Firm*—Buhler & Associates; Kirk A. Buhler

(57) ABSTRACT

Improvements to a portable fire extinguisher where the improvements relate to a system where the owner of the extinguisher can service and maintain their fire protection. Systems in place today require the servicing of a third party. The service companies (third parties) are charged with maintaining the system. Further Improvements include an anti-bridging mechanism that is articulated from the exterior of the chamber to fluff, mix or stir the powder within the chamber to keep it in a liquefied state. An external pressurized canister allows easier servicing or replacement of the pressurized canister as well as the ability to maintain the chamber in an un-pressurized condition, allowing non-HASMAT shipping. These features extend the service intervals while maintaining the fire extinguisher in a ready condition. The fire extinguisher is construction of components that are interchangeable and provide equal operation for left and right handed people.

19 Claims, 4 Drawing Sheets

U.S. PATENT DOCUMENTS

| | | | | |
|---|---|---|---|---|
| 3,713,493 | A | 1/1973 | Hansen | |
| 4,372,394 | A | 2/1983 | Allegri, Sr. | |
| 4,567,948 | A | 2/1986 | Rozniecki | |
| 4,650,004 | A | 3/1987 | Wendling et al. | |
| 4,862,968 | A | 9/1989 | Woodman | |
| 6,189,624 | B1 | 2/2001 | James | |
| 6,527,058 | B1 | 3/2003 | Nerat | |
| 7,128,163 | B1 * | 10/2006 | Rousseau et al. | 169/77 |

* cited by examiner

SELF SERVICING FIRE EXTINGUISHER WITH EXTERNAL OPERATED INTERNAL MIXING WITH WIDE MOUTH AND EXTERNAL PRESSURIZED CANISTER

CROSS REFERENCE TO RELATED APPLICATION

This application is a continuation-in-part of applicant's application Ser. No. 11/266,815 filed Nov. 4, 2005 now U.S. Pat. No. 7,128,163.

FIELD OF THE INVENTION

This invention relates to improvements in portable fire extinguishers or delivery system. More particularly, the present invention relates to a fire extinguisher that allows for external mixing, fluffing, actuating or stirring of the powder within the chamber to provide anti-bridging of the powder to keep it in a liquefied state, a larger opening in the chamber to allow easier filling of the chamber and a pressurized canister that is located external to the extinguisher chamber.

BACKGROUND OF THE INVENTION

Most portable fire extinguishers are of a similar design where the fire extinguishing powder is contained in a pressurized chamber. Fire extinguishers of this type require scheduled maintenance because the powder within the chamber can settle and cake preventing it from being dispensed when needed. The pressure within the chamber may also leak over time and be insufficient to propel the powder out of the dispensing nozzle. A further limitation, based upon this design is due to the pressurized condition of the chamber, powder is placed into the chamber in a small opening in the top of the extinguisher. This scheduled maintenance allow moisture intrusion causing caking. Current extinguishers can only be service by trained certified technicians, and the certification is issued by the fire marshal for each state. The current fire system in place today requires the services of a third party. The service companies (third parties) are charged with maintaining the system. They cannot in fact meet the standards required of them. They cannot meet the requirements of the UL label. Nor can they meet the manufacturer's requirements.

UL states each extinguisher must be maintained in the same manner as it was tested. The powder must be the manufacturer's powder. The lubricants must be the same manufacturer's brand. The hanger must be of the same manufacturer. If these requirements are not met the UL listing is voided and the extinguishers must be recalled. It is impossible for any service company to meet these requirements. All service firms perform the maintenance of the extinguishers in service vehicles. These vehicles are small vans or pick-up trucks. They can carry at most two recovery systems, one for ABC and one for BC. There are no service vehicles capable of carrying a recovery system for each brand of extinguisher as required by UL. All extinguishers in service today have contaminated powder and the UL has been voided. This also speaks to the lubricants and parts as well.

The manufacturer and NFPA-10 standards also impose standards that cannot be met by the service firms. The manufacturers require that only their powder, parts and lubricants must be used in their products. They also require standard for the servicing of the same. The concern for the environmental impact on their powder i.e. the humidity level, the amount of air the powder is exposed too, the mixing of powder. The manufacturers produce their product in a controlled environment and as such can protect against caking and maintaining a fluid effect with their powder. The current extinguishers use chemical recycled thru a recovery system thus the mixing of chemicals. This extinguisher has the only enclosed chemical cartridge and no mixing of the chemical can take place.

Mixing the powder and using their own brand of lubricants and parts they allow an abundance of air in various stages to compromise the powder. Currently the only prevention for this is to never open the extinguisher and to return it to the manufacturer when it is required to be hydro tested or to have the six-year tear down to clear the powder. It is commonly understood that because the current system is made up of pressurized portable fire extinguishers resulting in the compaction of the powder and therefore must be fluffed. The current system is plagued with serious problems. The service firms have very little supervision and are in a position to abuse the public. Most enforcement officers are charged with other more serious duties, i.e. arson etc. and has little time to dedicate to a system that is in fact impossible to maintain. The vast majorities of service firms operate out of the back of their trucks and are continually on the move, making them difficult to locate and to implement any type of enforcement.

Another limitation with portable fire extinguishers that are currently available is that the fire extinguishes can only be shipped by land because they are pressurized, and could rupture when they are shipped by air. The around shipping is a HASMAT requirement that the proposed portable fire extinguisher would not have because the tank is not pressurized.

Current extinguishers are open to wear and tear because of the constant pressure and the tear down process. When serviced they are fired into a recycling chamber and all he parts must be disassembled and cleaned. All the pressure rings must be replaced and every part must them be reassembled with new powder being placed within the chamber prior to pressurizing the chamber. The servicing of current fire extinguishers often creates more wear and tear on the fire extinguisher than when it is used to extinguish a fire.

U.S. Pat. No. 6,189,624 issued to James on Feb. 20, 2001 and Japan Patent Number JP9,225,056 issued to Yamazaki Tomoki on Sep. 2, 1997 disclose fire extinguishing mechanisms where the chamber is not continuously pressurized, and the pressurized chamber is a separate entity integrated within the chamber. While these patents disclose a separate pressurized canister, the canister is not located in a position that is easy to service, replace, or inspect. This minimizes the ability determine the charge level of the $CO_2$ cartridge.

U.S. Pat. No. 2,541,554 issued to C H Smith on Feb. 13 1951 and Russian Patent Number RU 2,209,101 issued to Glavatski G. D. Et Al. Nov. 2, 2002 discloses a fire extinguisher with external $CO_2$ gas cartridge. In the case US '554 the $CO_2$ gas cartridge sits on top of the fire extinguisher chamber and is not integrated within the handle of the fire extinguisher. In the case of RU '101 the $CO_2$ gas cartridge is external to the extinguisher and is connected to the extinguisher with a pipe or hose. While both of these patents disclose a $CO_2$ cartridge that is external to the chamber, neither of them is placed in the handle to allow a configuration of the fire extinguisher that is simple to inspect and replace.

Russian Patent Number RU2,209,101 issued to Glavatski G. D. Et Al. Nov. 2, 2002 discloses a fire extinguisher with an internal fluffing mechanism consisting of a coiled spring.

It is known that one of the problems with powder type fire extinguishers is the possibility that the extinguishing powder within the chamber can cake and harden if it is not fluffed to keep the powder in liquid configuration. While the RU '101 patent discloses a fluffing mechanism, the fluffing mechanism is operated by a wound spring, and one the spring has been used there is no mechanism to wind the spring. The proposed product does not have this limitation because it provides an external mechanical interface that allows a user to manually fluff the powered.

Due to the pressurized condition that exists with pressurized fire extinguishers, the opening where powder is placed into the extinguisher is limited due to the structural requirement to maintain pressure within the chamber at all times. The proposed application eliminates this need by providing an external pressurized gas cartridge, thus allowing the chamber to exist in a normally un-pressurized condition. Because the chamber is not under pressure the top opening of the extinguisher can be enlarged to allow easier filling of the fire extinguisher with powder, or checking the amount and or condition of the powder within the chamber. This extinguisher does not require this testing, it is not pressurized constantly, only when it is needed to extinguish a fire and then it only holds pressure for the maximum of a minute.

What is needed is a fire extinguisher with an external gas cartridge where the gas cartridge is located in the handle, a fluffer is accessible from outside the chamber, and the chamber has an enlarged top opening for filling the extinguisher. The proposed fire extinguisher provides this solution by providing a fire extinguisher with an external gas cartridge, external fluffer and large opening.

BRIEF SUMMARY OF THE INVENTION

It is an object of the fire extinguisher to eliminate the need for service personnel to enter secure areas. The extinguisher can have a higher level of service. Can be operated automatically "self service" and or manually services by the owner or end user. This eliminates the need for non-employees to enter the privacy of business and government areas. This extinguisher can be operated, maintained, refilled and charged with no special training or equipment allowing for anyone who purchases it to have it function like any of the office equipment that is available to day like a copier, printer or water cooler. The proposed fire extinguisher is not required to be broken down when it has been fired.

The reduced outside servicing and maintenance of the fire extinguisher is ideal for placement of the fire extinguisher to be placed in secure areas. This will reduce or eliminate the possibility that a terrorist could utilize the fire extinguisher as a weapon, or use false identity as an extinguisher service person to gain access to a secure area.

It is an object of the fire extinguisher to provide a fire extinguisher with an external pressurized canister. The external canister allows the chamber to exist at or near ambient pressure that reduces the need to utilize a high strength chamber. The standard pressurized cartridge that is used in other applications can be easily adapted to operate with the fire extinguisher. Since the pressurized cartridge is external to the chamber it can be easily replaced or swapped without replacing the entire fire extinguisher. This provides a tremendous benefit when a large number of fire extinguishers need to be in service at one time.

It is another object of the fire extinguisher to provide a fire extinguisher with an externally accessible fluffing mechanism. The externally accessible fluffing mechanism promotes anti-bridging of the powder within the chamber to keep it fluffed, agitated, stirred or disturbed to prevent caking of the powder and keep the powder in a liquefied state so it is easier to spray the powder onto a fire. The fluffing is accomplished with paddles, flapper, chains rods or other mixing mechanisms located within the chamber. The mixing mechanism is accessed by a connection on the top, bottom or side of the chamber and can be either manually operated or operated with a key of some type.

It is another object of the fire extinguisher to provide automatic fluffing of the media inside the fire extinguisher using a powered fluffing mechanism that is powered with batteries, wind-up mechanism or is externally powered. A timing device can be used to fluff the contents at pre-defined intervals, or the mixing can be performed continuously at a pre-defined rate of rotation.

It is another object of the extinguisher to provide an extinguisher where there is no need for any tear down the powder is contained in the manufacturer's cartridge and the powder can be fluffed by the external mechanism at the base of the cartridge. The fluffier can be operated manually or with an electric motor, hard wired or battery operated. This extinguisher can be produced with a clear powder cartridge and the fluffing can be visibly inspected. This extinguisher provide the operator with several options such as the ability to recharge and fire as needed and to fire different fire retardant and it can also fire a liquid product. Fire departments can fire and recharge at the site, they no longer have to wait for a service firm to recharge the extinguisher.

It is another object of the extinguisher to provide a delivery systems that accommodated as much chemical as the cartridges available at the scene, five, ten, twenty, thirty, forty etc. without providing a limitation based upon the chemical and extinguisher sizes that are currently available.

It is another object of the fire extinguisher to provide a fire extinguisher that can be filled or refilled with a changeable canister of fire resistant material. The canister consists of a cup shaped cylinder that can be slid into the bottom or top of the fire extinguisher. Various types of fire extinguishing media can be installed and or changed by removing the bottom or top of the extinguisher and sliding a new or different type of fire extinguishing media inside of the fire extinguisher shell, and re-installing the bottom or top.

It is another object of the fire extinguisher to utilize a cylindrical shell with tabs, wings or protrusions that flip or extend towards the center of the body of the extinguisher. The tabs, wings or protrusion aid in moving the fire extinguishing media towards the fluffing appendages. The shell may alternatively provide the fluffing and mixing of the fire extinguishing media to maintain the media in an optimal condition.

It is another object of the fire extinguisher to provide a fire extinguisher that can be shipped by overnight or air carrier. Since the fire extinguisher exists in a non-pressurized condition there is no hazard of explosion of the pressurized canister. The pressurized canister is inserted into the fire extinguisher when it arrives at its destination.

It is another object of the fire extinguisher to provide a delivery system which dispenses various types of fire retardant and can be reused at the point of attack without the need for special pressurized equipment or specially trained certified personnel. This extinguisher is specially designed so that all parts are interchangeable. These features provide a wider range of fire suppression available for the on line fire fighters.

It is another object of the fire extinguisher to provide a fire extinguisher with interchangeable parts where the heads and cylinders of each of the extinguishers can be interchanged with the head and cylinder from another fire extinguisher. Today each extinguisher must be refitted with the head it was manufactured with. If the heads are not replaced on the manufactured cylinder the instruction labels and the gauges do not line up and the extinguisher must be condemned. The current extinguishers display the instructions on the left side of the extinguisher and the safety pin is on the left side of the extinguisher, the gauge is on the left side of the extinguisher each of these make it difficult for the user who is right handed. This extinguisher has the instructions on the top, making it easier for both the right and left handed users.

It is another object of the fire extinguisher to provide a fire extinguisher that does not have a gauge. The current extinguishers cannot be refilled or recharged by the owner they must be recharged and pressurized by a third party. This extinguisher can be recharged by the end user, the owner. Current extinguishers can only be used with the designated powder it is filled with and because each extinguisher is pressurized it can only be recharged by a certified technician with the necessary pressurizing equipment. This extinguisher has a cartridge loaded powder with a fluffing mechanism and is interchangeable for whatever retardant is required. It is not pressurized and can be changed by the operator. This extinguisher is only pressurized when it is needed to extinguish a fire. Current extinguishers are pressurized at 195 PSI and over a period time this creates compacting and bridging and the pressure can leak out of the cylinder.

It is another object of the fire extinguisher to provide a fire extinguisher that is designed with both the safety pin and the hose retainer for ease of access for right and left handed person. Since the majority of individuals are right handed this creates real problems in life threatening situations. This extinguisher can accommodate both the right handed or left handed person.

It is another object of the fire extinguisher that includes the chemical cartridge and the fluffier and the head (delivery system) in a complete unit. The major uniqueness is the over all user friendly system. This extinguisher is a system for the multi delivery of fire retardant. This extinguisher eliminates the need for a government regulated ineffective third party and places the responsibility for protection in the hands of the individual. The current extinguisher requires a separate extinguisher for each chemical retardant, i.e. ABC, BC, Purple K etc. This extinguisher with its delivery head can apply all chemicals.

It is another object of the fire extinguisher to provide a fire extinguisher that can deliver as much retardant and the correct type of retardant called for at the immediate fire location. With the proposed fire extinguisher the fire retardant is no longer limited by the delivery system. The retardant can be available on the fire fighters equipment and can be dispensed at the scene. The proposed fire extinguisher has the chemical separately contained in fire resistant plastic cartridges that are clearly marked with the corresponding chemicals required for the immediate fire threat.

It is still another object of the fire extinguisher to provide a fire extinguisher with an enlarged filling opening. The enlarged filling opening makes it easier and faster to fill and or empty the chamber. The top can also be easily removed to visually inspect the condition of the powder within the chamber.

Various objects, features, aspects, and advantages of the present invention will become more apparent from the following detailed description of preferred embodiments of the invention, along with the accompanying drawings in which like numerals represent like components.

DETAILED DESCRIPTION

Figure 1:
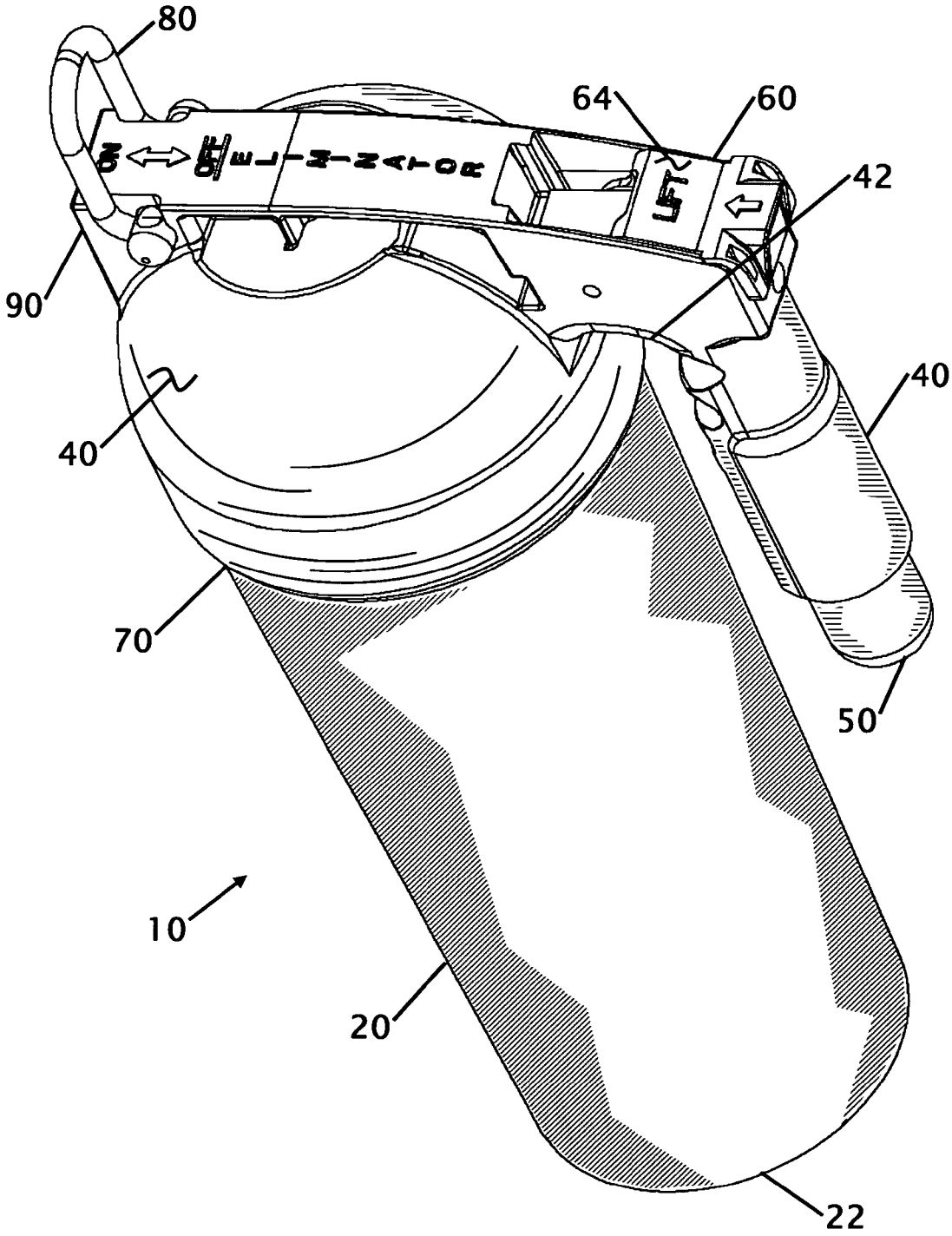
FIG. 1 shows an isometric view of a preferred embodiment of the improved fire extinguisher.

FIG. 1 shows an isometric view of a preferred embodiment of the improved fire extinguisher 10. The chamber 20 is substantially a cylindrical shape with a bottom 22 and a top. In the preferred embodiment the chamber is molded from a lightweight resilient material, but it is further contemplated that the chamber be made of aluminum, steel, brass or copper. The preferred embodiment of plastics allows the extinguisher to be placed in locations that could cause corrosion of metals. The top 40 is screwed onto the chamber, but it could also be attached with a bayonet or latching mechanism. The top 40 fits on top of an enlarged opening 70 on the chamber to allow easier filling of the chamber 20 with fire retardant materials. A wall hanging mechanism can be incorporated into the top of the extinguisher, wrap around the body of the cylinder or fork the top of the extinguisher. A handle 40 allows the operator to hold the extinguisher in an upright orientation when it is being used. The fire extinguisher can also be stored and or transported in the upright orientation, but the upright orientation is not critical for the storage or operation of the extinguisher. Within the handle 40 a pressurized canister 50 is located. While in the preferred embodiment the pressurized canister is shown within the handle other locations such as within the top of the extinguisher or adjacent to the hose are contemplated.

The canister consists essentially of a pressurized chamber, but canisters of different types of gas are possible that do not promote spreading of the fire. Because the gas within the canister is under high pressure or in a liquid state, a small canister of pressurized gas is required to expel the contents of the chamber 20. It is also contemplated that multiple pressurized canisters can be placed within the handle to accommodate a larger fire extinguisher without deviating from the inventive nature of the design. Pressurized canisters are available from a variety of sources and can be replaced or serviced without the need to service the entire fire extinguisher. The handle 40 provides some protection to the canister in the event the fire extinguisher is dropped or roughly handled. An arm 42 extends from the underside of the handle 40 to provide structural strength to the top of the fire extinguisher as well as providing a hole for gripping. A flip open door mechanism located on the top of the fire extinguisher 60 and is raised to expose the trigger located under the door 60. The trigger mechanism opens the pressurized canister to pressurize the chamber and expel the fire extinguishing media out the front of the extinguisher out the application nozzle 90.

The location of the activation trigger the fire extinguisher to provide a fire extinguisher that is designed with both the safety pin and the hose retainer for ease of access for right and left handed person. Since the majority of individuals are right handed this creates real problems in life threatening situations. The trigger on top of the fire extinguisher and requires the operator to press down on the extinguisher to operate the extinguisher, but other embodiments are contemplated including but not limited to a finger trigger or a slide mechanism. A safety pin can be incorporated to prevent accidental operation of the extinguisher. The extinguisher is hung from a wall using a fork type holder that is not shown. It is further contemplated that the top housing has an extended tab on one or more side for hanging on an existing wall hanger. The extended tab includes a variety of details located on the top and sides of the extended tab for mounting on wall hangers that are available with older fire extinguisher.

The extinguisher has an expelling valve 80 that is rotated to open the nozzle 90. This valve can be rotated back to the closed position to prevent extinguishing powder from pouring out of the extinguisher when not desired. The path from the pressurized canister 50 to the nozzle 90 is best shown and described in FIG. 2.

Figure 2:
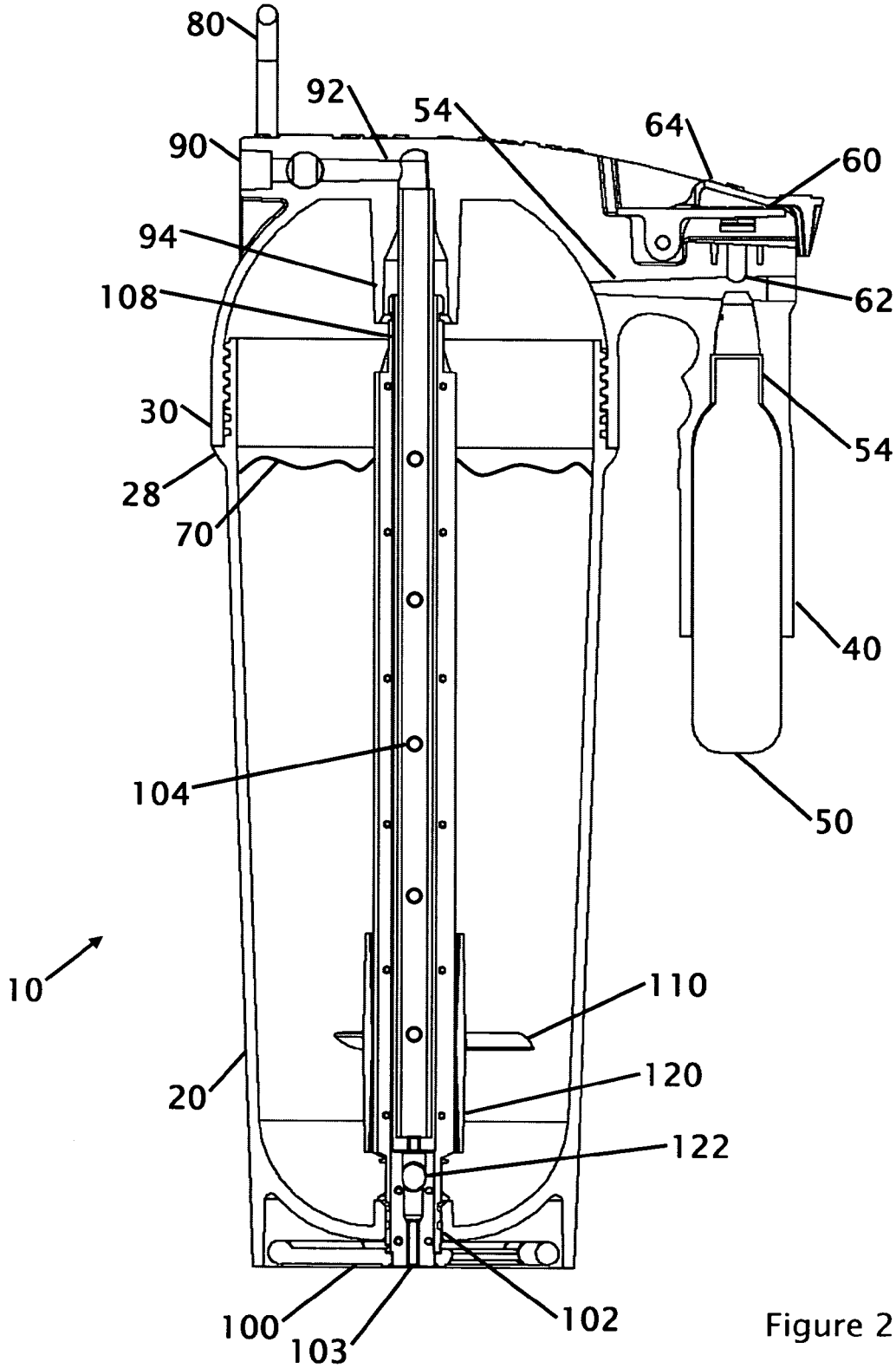
FIG. 2 shows a side sectional view of the preferred embodiment of the fire extinguisher shown in FIG. 1.

FIG. 2 shows a side sectional view of the preferred embodiment of the fire extinguisher 10 shown in FIG. 1. This figure shows the chamber 20 filled with the fire extinguishing media 70 such as chemical retardant ABC, BC, Purple K etc. Various types of fire extinguishing media can be placed within the chamber. The upper portion of the chamber includes an enlarged opening 28 where it joins with the top 30 of the extinguisher. The enlarged opening 70 is greater than 50% of the diameter of the cylindrical fire extinguisher, but could be up to and including the same diameter as the cylinder with a threading mechanism located on the exterior lip of the cylinder at one or both ends of the cylinder. Threading or other fastening means is used to secure the top 30 and or bottom of the fire extinguisher onto the cylinder. The fastening means can be with internal or external threading on the cylinder and mating end closures or by methods of fastening such as but not limited to bayonet, pins, welding or adhesives. It is also contemplated that the cylinder be fabricated from tubular stock where both the top and the bottom of the extinguisher is identical and the ends are attached to the tube when the fire extinguisher is assembled. The bottom of the extinguisher 20 has a port, hole or opening 102 to allow access to the fluffing knob 100. In the preferred embodiment the top opening is between 75% and 90% of the diameter of the fire extinguisher. The larger opening allows the contents of the fire extinguisher to be filled, emptied, inspected, and serviced more easily. The top is screwed onto the chamber, but it could also be attached with a bayonet or latching mechanism. The top 30 of the fire extinguisher provides the propellant and the connections to emit the fire extinguishing material 70.

The head (delivery system) has an emission port and an entry port plus a pick-up tube. It has a safety guard 64 over the charging pin and a lever 60 to fire the powder through the emission port. The powering cartridge 50 is easily installed in the handle 40 attached to the head of the extinguisher. The powder cartridge has a fluffier tube with an opening to accept the pick-up tube within the head. Current fire extinguishers must be torn down every six years to fluff the powder, check for caking and to check the condition of the chemical. This extinguisher does not have to be broken down; the powder can be fluffed each month, once a year or the chemical cartridge can simple be replaced. The current fire extinguishers have to be subjected to a hydo test every five years for fleet vehicles and every twelve years for the standard extinguishers.

A gas filled pressurized canister 50 is located within the handle 40 of the extinguisher. It can be seen from this figure that the pressurized canister exists substantially within the handle. The handle provides some protection to the canister for accidental damage. A small portion of the pressurized canister extends beyond the end of the handle to allow access to the pressurized canister so it can be installed, removed or serviced without the need to disassemble other parts of the fire extinguisher. The pressurized canister is threaded into a fitting 52 within the handle of the extinguisher. The fitting can be of a variety of types that allows engagement of the canister to the extinguisher allowing the gas to be exhausted from the canister into the body of the fire extinguisher. A trigger 60 or other activation mechanism controls a valve 62 to regulate the flow of the gas from the canister through tube 54 and into the fire extinguisher. The end of the inlet tube 54 blows gas into the cylinder such that it creates a swirl of the fire retardant media. Various safety pins, locks, tabs or other devices can be incorporated to reduce or prevent the possibility of accidental activation of the trigger.

In this FIG. 2 the chamber is shown to provide a view of the fluffing mechanism(s) 120. The fluffing mechanism conditions the fire retardant media to provide anti-bridging of the media within the chamber to agitate, fluff, turn, disturb, stir, ruffle, and or alters the condition of the media to allow the media to maintain a powder consistency. This allows the fire retardant powder media to remain in a liquefied state so it is easier to spray the powder onto a fire. The conditioning of the media can be performed using a variety of methods and in the preferred embodiment the conditioning is performed with an appendage 110 that can be articulated from the exterior 100 of the chamber. The appendage is a shaft that extends the length of the chamber and has a number of flaps 120 attached to the appendage. While flaps are shown and used in the preferred embodiment a variety of other appendages are contemplated that can condition the media that include but are not limited to rods, paddles, arms, disks, cable, chains or combination thereof. It is also contemplated that the appendage can be a simple hook or chain that conditions the fire extinguishing media.

The fluffer is formed from two halves of material that is joined to create the fluffing shaft. It is contemplated that the fluffing can be accomplished by blowing gas into the chamber through a hole 103 and through the fluffing shaft to fluff the media within the chamber where the gas blows through the shaft and out fluffing holes 104. As previously described the appendage terminates 100 at the bottom of the chamber where it can be articulated, but the appendage could terminate at the top or sides of the chamber. The termination at the bottom of the chamber 100 to allow articulation that requires either a key to attach to the appendage, or may terminate with manual knob, handle, wheel or other extension. A manually rotatable handle is shown for manual fluffing of the fire extinguishing media.

The nozzle 90 can be turned to direct the spray of fire retardant material as desired. A valve handle 80 is rotated up to allow the fire extinguishing media to be expelled and rotated down to block the flow of fire retardant material from falling out of the extinguisher when the tank is tipped. In operation when the trigger 60 is depressed the valve 62 is opened and gas from the canister 50 is expelled from the tube 54 into the chamber 20. The chamber becomes pressurized and fire suppressant media 70 is pushed into hole 122 in the bottom of the chamber where it is further pushed up through the central shaft and through the head 92 and out the nozzle 90 where it is dispensed out the opening. The nozzle is shown in a fixed direction but in another contemplated embodiment the nozzle is flexible to allow a user to hold the fire extinguisher and direct the fire extinguishing media out of the nozzle to a fire. While a nozzle is shown in the preferred embodiment other dispensing orifices can be used such as valves, tubing, spray nozzles or similar are contemplated. It is contemplated that an over pressure relief valve can be incorporated within the fire extinguisher to vent any excessive pressure from within the cylinder that could cause the fire extinguisher to burst due to over pressurization of the chamber.

Another contemplated feature can be a pressure gauge that will provide information on the amount of pressure in the canister to ensure that it is sufficiently charged for use when needed. After using the fire extinguisher, it can be opened, refilled and the canister replaced to allow the fire extinguisher to be returned to service like other types of office equipment like copiers or printers. This is shown and described in more detail with FIG. 6.

Figure 3:
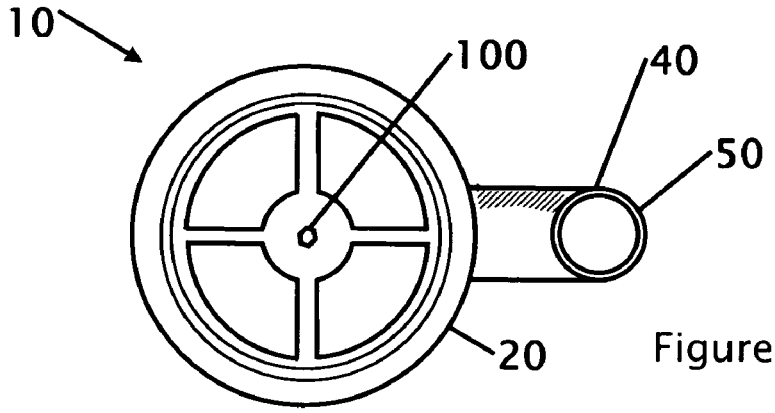
FIG. 3 shows a bottom view of the preferred embodiment of the fire extinguisher shown in FIG. 1.

FIG. 3 shows a bottom view of the preferred embodiment of the fire extinguisher 10 shown in FIG. 1. This view is one contemplated embodiment with access to the articulating appendage with a hex or similar key drive 100 attachment and a handle knob 105 that can be manually turned to fluff the fire retardant media within the chamber 20. A battery powered drill or screwdriver can be attached to the hex drive socket and the powder within the fire extinguisher can be quickly fluffed. It is further contemplated that the fluffer could be operated by an automatic or manual motor that operates on a timer to fluff the powder at intervals. In this view the canister 50 is shown within the handle 40. In assembling the extinguisher the end of fluffing shaft 108 is guided into the orifice 94 in the top housing.

Figure 4:
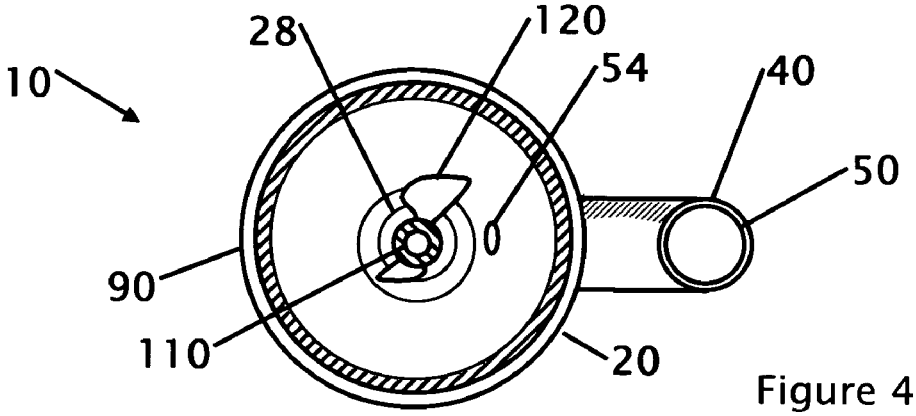
FIG. 4 shows a mid cylinder sectional view of the preferred embodiment shown in FIG. 1.

FIG. 4 shows a mid cylinder sectional view of the preferred embodiment shown in FIG. 1. This sectional view is cut through the chamber 20 to show the flapper(s) 120 on the appendage 110. The inlet tube 54 from the pressurized canister is shown in one contemplated location. The end of the inlet tube 54 is shown. The pressurized canister 50 is shown within the handle 40 shown in the safety or bent down orientation. The exhaust hole 82 is shown that transports fire retardant media from the fire extinguisher out the application nozzle 90.

Figure 5:
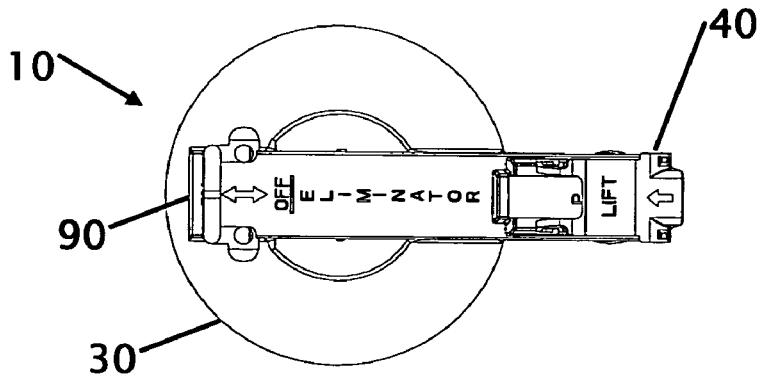
FIG. 5 shows a top view of the preferred embodiment of the fire extinguisher shown in FIG. 1.

FIG. 5 shows a top view of the preferred embodiment of the fire extinguisher 10 shown in FIG. 1. This view is one contemplated view as the fire extinguisher would appear when viewed from the top of the extinguisher. The pressurized canister is not visible because it is covered with the top housing and the handle 40. The handle 40 further provides some protection to the pressurized canister to reduce the possibility of damaging the pressurized canister. The chamber exists under the top 30 of the fire extinguisher and the nozzle 90 is shown on the side opposite the handle.

Figure 6:
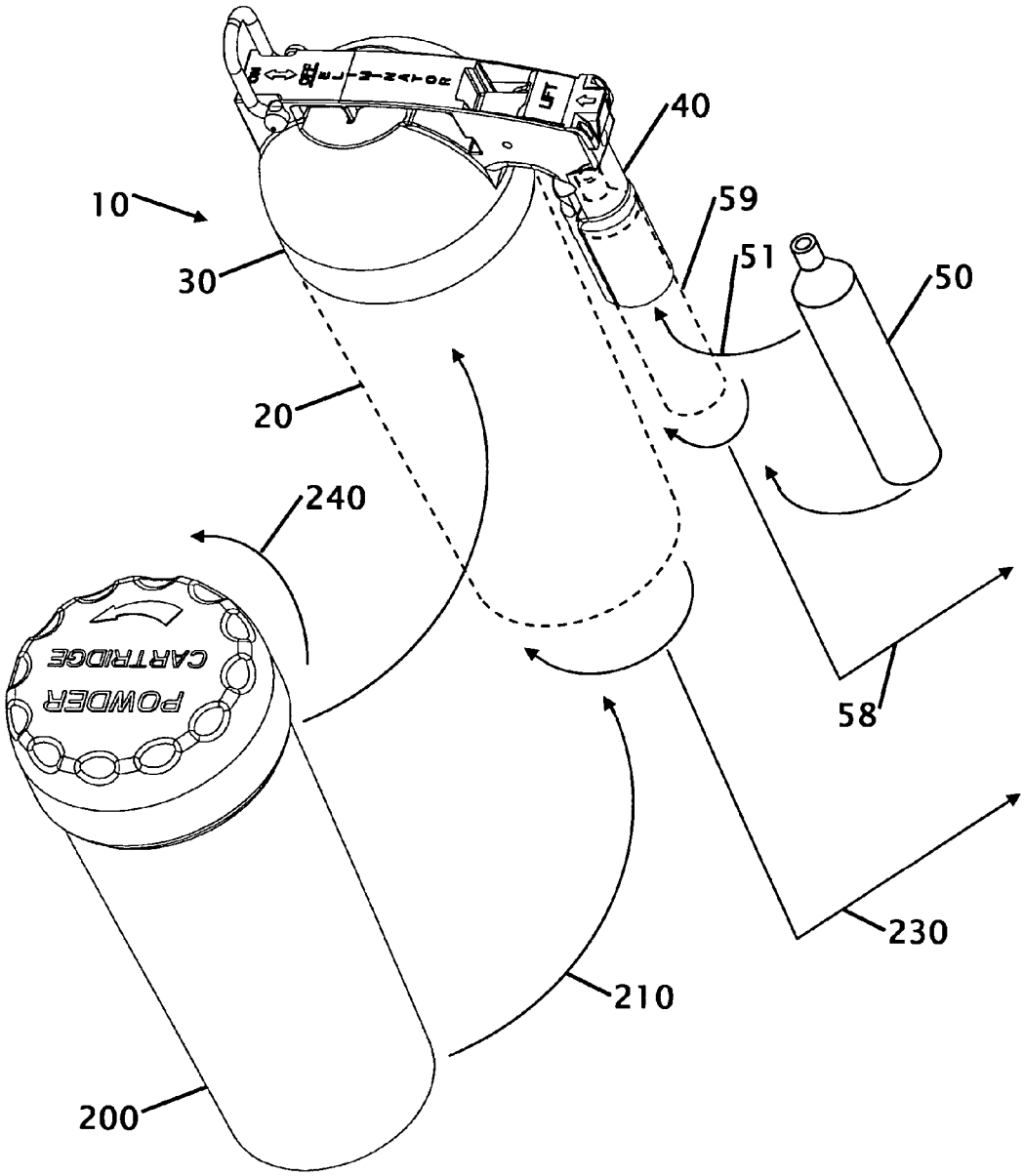
FIG. 6 shows a re-filling operation that allows a spent extinguisher to be re-filled or re-charged.

FIG. 6 shows a re-filling operation that allows a spent extinguisher to be re-filled or re-charged. The top 30 of the fire extinguisher is removed 230 from a used body 29 of the fire extinguisher 10. Any remaining fire retardant powder is discarded. The mixing of old and new fire retardant material as well as the mixing of fire retardant material from different manufacturers as well as different types of fire retardant material causes contamination to the fire retardant material and makes the fire retardant material less effective. The top of a refill canister 200 of appropriately rated fire retardant material is removed 240 and the new powder cartridge is installed 210 onto the top 30 of the spend fire extinguisher 30. The spent gas cartridge 59 is removed 58 and a new gas cartridge 50 is inserted 51 into the handle of the fire extinguisher. In one contemplated use of the fire extinguisher, a fireman can carry the fire extinguisher a power refill cartridges 200 and pressurized canisters 50. Once the extinguisher has been used the fireman can re-fill the canister at the fire. The fireman can also carry an empty fire extinguisher with a variety of fire extinguishing media, and can fill the fire extinguisher at the site of the fire once they determine the most appropriate material to use on the fire.

One contemplated fill or refill mechanism is shown as where fire retardant material is contained within the cartridge 200. In this contemplated embodiment the cartridge slides into the fire extinguisher cylinder body 20. The fire extinguishing media cartridge 200 is configured with wing, arm, flap or tabs that are articulated from the exterior of the replacement cartridge to keep spare cartridges sufficiently fluffed and ready for use. The spent fire suppressant media cartridges and or pressurized cartridges are recyclable for future re-use.

Thus, specific embodiments of an improved fire extinguisher have been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. A portable fire extinguisher comprising:

a predominantly plastic fire extinguisher having a top and a molded cylindrical chamber containing fire suppressing media, a firing pin trigger within the top of the extinguisher under a covering flap such that the covering flap must be moved to expose the firing pin trigger, and when the firing pin trigger is depressed, it is pushed through a seal in a replaceable pressurized cartridge whereby releasing gas from the pressurized cartridge that enters the fire extinguisher to expel the fire suppressing media out an exit port on the fire extinguisher.

2. The portable fire extinguisher according to claim 1 which the molded cylindrical chamber further includes a shaft that extends from within the molded cylindrical chamber to the exterior of the molded cylindrical chamber where a portion of the shaft within the molded cylinder chamber includes one or more rods, paddles, arms, disks, chains or combination thereof for articulating the fire suppressing media within the chamber.

3. The portable fire extinguisher according to claim 1 in which the top, the molded cylindrical chamber, the pressurized cartridge and fire suppressing media from one fire extinguisher can be interchanged with the top, the molded cylindrical chamber, the pressurized cartridge and fire suppressing media with another fire extinguisher or.

4. The portable fire extinguisher according to claim 1 that further includes a port that extends from the exterior of the molded cylindrical chamber to the interior of the molded cylindrical chamber where it exits in the interior of the molded cylindrical chamber with fluted holes or grooves whereby when air or gas is blown into the port the fire suppressing media is fluffed.

5. The portable fire extinguisher according to claim 1 that further includes an operable valve mechanism that controls the exit port to release or retain the fire suppressant media within the molded cylindrical chamber.

6. The portable fire extinguisher according to claim 1 in which the fire extinguisher is constructed to provide equally efficient operation from a left-handed and right-handed person.

7. The portable fire extinguisher according to claim 1 in which the molded cylindrical chamber is clear so the fluffed condition of the fire suppressing media can be visibly inspected.

8. A portable fire extinguisher comprising:

a cylindrical chamber containing fire suppressant media with a top configured with a trigger for releasing a pressurized gas from a pressurized gas canister into the cylindrical chamber with an exit port for expelling fire suppressant media located within the cylindrical chamber;

the top of the chamber further includes an operable valve mechanism that is separate from the trigger, to control the release of the fire suppressant media within the cylindrical chamber through the exit port, and the cylindrical chamber further includes a shaft that extends from within the cylindrical chamber to the exterior of the cylindrical chamber where a portion of the shaft within the cylinder includes one or more rods, paddles, arms, disks, chains or combination thereof for articulating the fire suppressing media within the cylindrical chamber.

9. The portable fire extinguisher according to claim 8 wherein the operable valve mechanism provides the function of storing and or releasing pressure within the cylindrical chamber.

10. The portable fire extinguisher according to claim 8 in which the cylindrical chamber, pressurized gas canister and fire suppressing media from one fire extinguisher can be interchanged with the cylindrical chamber, pressurized gas canister and fire suppressing media with another fire extinguisher.

11. The portable fire extinguisher according to claim 8 that further includes a firing pin trigger located under a covering flap such that the covering flap must be moved to expose the firing pin trigger, and when the firing pin trigger is depressed the cylindrical chamber is pressurized.

12. The portable fire extinguisher according to claim 8 that further includes a port that extends from the exterior of the cylindrical chamber to the interior of the chamber where it exits on the interior of the cylindrical chamber with fluted holes or grooves whereby when air or gas is blown into the port the fire suppressing media is fluffed.

13. A portable fire extinguisher comprising:

a cylindrical chamber that contains fire suppressing media, a port that extends from the exterior of the cylindrical chamber to the center of the interior of the cylindrical chamber, where the port on the interior of the chamber is a rigid vertical tube having fluting holes or grooves;

whereby when air or gas is blown into the port on the exterior of the cylindrical chamber the fluting holes or groves fluff the fire suppressing media to maintain a powder consistency.

14. The portable fire extinguisher according to claim 13 in which the cylindrical chamber and fire suppressing media from one fire extinguisher can be interchanged with the cylindrical chamber and fire suppressing media with another fire extinguisher.

15. The portable fire extinguisher according to claim 13 that further includes an operable valve mechanism that controls the exit port to release or retain the fire suppressant media within the cylindrical chamber.

16. The portable fire extinguisher according to claim 13 that further includes a firing pin trigger located under a covering flap such that the covering flap must be moved to expose the firing pin trigger, and when the firing pin trigger is depressed the cylindrical chamber is pressurized.

17. The portable fire extinguisher according to claim 13 which the cylindrical chamber further includes a shaft that extends from within the cylindrical chamber to the exterior of the cylindrical chamber where a portion of the shaft within the cylinder includes one or more rods, paddles, arms, disks, chains or combination thereof for articulating the fire suppressing media within the chamber.

18. The portable fire extinguisher according to claim 13 in which the fire extinguisher is constructed to provide equally efficient operation from a left-handed and right-handed person.

19. The portable fire extinguisher according to claim 13 in which the molded cylindrical chamber is clear so the fluffed condition of the fire suppressing media can be visibly inspected.

* * * * *